US011224780B2

(12) United States Patent
Ludovici

(10) Patent No.: US 11,224,780 B2
(45) Date of Patent: Jan. 18, 2022

(54) MACHINE FOR ASSISTED PHYSICAL ACTIVITY EXERCISE

(71) Applicant: LACERTOSUS S.R.L., Parma (IT)

(72) Inventor: Antonio Ludovici, Fiuggi (IT)

(73) Assignee: LACERTOSUS S.R.L., Parma (IT)

( * ) Notice: Subject to any disclaimer, the term of this patent is extended or adjusted under 35 U.S.C. 154(b) by 0 days.

(21) Appl. No.: 16/764,022

(22) PCT Filed: Oct. 26, 2018

(86) PCT No.: PCT/IB2018/058357
§ 371 (c)(1),
(2) Date: May 14, 2020

(87) PCT Pub. No.: WO2019/097332
PCT Pub. Date: May 23, 2019

(65) Prior Publication Data

US 2020/0276468 A1 Sep. 3, 2020

(30) Foreign Application Priority Data

Nov. 20, 2017 (IT) ..... 102017000132141

(51) Int. Cl.
*A63B 21/00* (2006.01)
*A63B 23/04* (2006.01)
*A63B 21/06* (2006.01)

(52) U.S. Cl.
CPC ..... *A63B 21/4033* (2015.10); *A63B 21/4039* (2015.10); *A63B 21/4045* (2015.10); *A63B 23/0482* (2013.01); *A63B 21/0615* (2013.01)

(58) Field of Classification Search
CPC ..... A63B 21/0615; A63B 21/0616; A63B 21/0617; A63B 21/062; A63B 21/0624;
(Continued)

(56) References Cited

U.S. PATENT DOCUMENTS 4,923,195 A * 5/1990 Calderone ..... A63B 21/0615 482/97
6,358,189 B1 * 3/2002 Koenig ..... A63B 21/0615 482/136

(Continued)

FOREIGN PATENT DOCUMENTS

CN 2313624 Y 4/1999
CN 203436769 U 2/2014

(Continued)

*Primary Examiner* — Nyca T Nguyen
*Assistant Examiner* — Zachary T Moore
(74) *Attorney, Agent, or Firm* — Pearne & Gordon LLP

(57) ABSTRACT

Described is a machine for assisted physical activity exercise, comprising a base (4) and supporting means (2, 3) for a user, comprising a seat (3) and/or a backrest (2). The assisted physical activity exercise machine (1) comprises a training tool (6) mounted on the base (4). The training tool comprises an engagement portion (7), configured for being actuated by a user, and guiding means (8) associated with the engagement portion (7) for guiding it at least according to a lifting movement. The supporting means (2, 3) are mounted on the base (4) and comprise a slide (100) slidably mounted on the base (4) according to an adjustment movement. The slide (100) supports the seat (3) and/or the backrest (2).

5 Claims, 2 Drawing Sheets

(58) Field of Classification Search
CPC ..... A63B 21/0626; A63B 21/0628; A63B 21/159; A63B 21/4033; A63B 21/4029; A63B 21/4031; A63B 21/4045; A63B 21/4047
See application file for complete search history.

(56) References Cited

U.S. PATENT DOCUMENTS

| | | | | |
|---|---|---|---|---|
| 7,104,934 | B1 * | 9/2006 | Smith | A63B 21/0615 482/44 |
| 8,172,736 | B2 | 5/2012 | Contreras | |
| 9,919,179 | B2 | 3/2018 | Nevarez | |
| 10,441,837 | B2 | 10/2019 | Nevarez | |
| 10,709,930 | B2 * | 7/2020 | Fleming | A63B 21/05 |
| 2002/0128131 | A1 | 9/2002 | Wu | |
| 2003/0134723 | A1 * | 7/2003 | Greenland | A63B 21/078 482/104 |
| 2009/0264265 | A1 * | 10/2009 | Contreras | A63B 23/0482 482/99 |
| 2011/0245047 | A1 * | 10/2011 | Dellino | A63B 21/4047 482/97 |
| 2012/0058870 | A1 | 3/2012 | Contreras | |
| 2012/0202654 | A1 | 8/2012 | Contreras | |
| 2016/0296784 | A1 | 10/2016 | Kamins | |
| 2017/0239518 | A1 * | 8/2017 | Porteros De Luz | A63B 23/0482 |
| 2018/0001131 | A1 * | 1/2018 | Nevarez, Jr. | A63B 21/0552 |
| 2018/0214732 | A1 | 8/2018 | Nevarez | |
| 2020/0338391 | A1 * | 10/2020 | Hall | A63B 23/0405 |

FOREIGN PATENT DOCUMENTS

| | | |
|---|---|---|
| WO | 2008077117 A1 | 6/2008 |
| WO | 2016154565 | 3/2016 |

* cited by examiner

MACHINE FOR ASSISTED PHYSICAL ACTIVITY EXERCISE

This invention relates to an assisted physical activity exercise machine.

More specifically, the physical exercise machine according to the invention has been developed to enable the so-called "Hip Thrust" physical exercise.

The Hip Thrust exercise is aimed at toning and strengthening the muscles of the buttocks.

During the performance of the exercise the athlete is positioned with his/her back on a suitable support and rests both soles of the feet on the floor. In this position the athlete performs repeated movements with the pelvis in a substantially vertical direction. If it is necessary to increase the intensity of the training, a balance bar, loaded as necessary, is positioned on the pelvis of the athlete.

This exercise is normally performed in gyms using common fitness sector benches to support the back.

These benches are generally used for other purposes, such as, for example, supporting athletes during exercises to be performed seated, such as bar lifting exercises or floor exercises, but they are often used, improperly, as supports for the back for performing pelvis lifting exercises.

A further method for performance of this exercise uses a specially configured bench. The bench has a supporting base which is substantially flat and connected to a backrest designed for supporting the athlete. The supporting base lies in a plane which is substantially parallel to the floor and the backrest is located in a position raised relative to it.

During the performance of the exercise the athlete is positioned with his/her back on the backrest, resting the feet on the supporting base whilst carrying out repeated lifts with the pelvis in a substantially vertical direction.

This type of bench does not allow an adjustment of the inclination and height of the backrest with respect to the ground, which, therefore, can be uncomfortable as well as inadequate for the performance of the exercise from a biomechanical point of view.

Moreover, performing the exercise with additional loads is very uncomfortable since the balance bar rests directly on the pelvis of the athlete and its not very ergonomic shape is often painful.

Another drawback is evident in this situation since the performance of the exercise with the application of additional loads requires the assistance of other people for the exercise to be performed in total safety, thereby obstructing and slowing down the training of other athletes.

In addition to these drawbacks, in the case of performance of the exercise with the normal fitness bench as support there is the problem of the stability of the bench which often slides or moves under the action of the athlete, making the performance of the exercise imperfect and sometimes harmful and dangerous for the athlete.

There has been a long felt need for providing an assisted physical activity exercise machine which allows performance of Hip Thrusts in complete safety and in compliance with the biomechanical principles which determine the correctness of the movements during the exercises of athletes.

The aim of this invention is therefore to overcome at least one of the above-mentioned drawbacks by providing an assisted physical activity exercise machine which allows the user to perform the Hip Thrust exercise in compliance with biomechanical principles and in complete safety.

According to the invention, the aim is achieved by an assisted physical activity exercise machine comprising the technical characteristics described in one or more of the appended claims.

This invention relates to an assisted physical activity exercise machine, comprising supporting means designed to support a user in the physical exercise. Preferably, the supporting means have paddings designed to make the use of the machine by the user more comfortable. More specifically, the supporting means comprise a backrest and/or a seat.

Preferably, the backrest lies mainly in a first plane and the seat lies mainly in a second plane.

Preferably, the angle between the first and the second plane is adjustable by means of suitable adjusting means.

The supporting means are mounted on a base and comprise a slide slidably mounted on the base according to an adjustment movement. The slide supports the seat and/or the backrest.

The assisted physical activity exercise machine comprises the base, which is configured to support the supporting means and a training tool.

Preferably, the base is made of a material with a high strength such as, for example, steel.

Preferably, the base comprises an upright located in a distal position relative to the backrest and preferably configured to support the training tool.

Still more preferably, the training tool is hinged to the top of the upright.

More specifically, the training tool comprises an engagement portion, configured for being actuated by a user, and guiding means associated with the engagement portion for guiding it at least according to a lifting movement.

Preferably, the engagement portion has a padding configured to make the use of the machine by the user more comfortable.

The technical features of the invention, according to the aforesaid aims, are clearly disclosed in the claims below, and their advantages will become more evident in the detailed description that follows, with reference to the accompanying drawings which represent one embodiment provided as a non-binding example, wherein:

With reference to the accompanying drawings, the numeral 1 denotes in its entirety an assisted physical activity exercise machine, hereinafter referred to as the machine 1.

More specifically, the machine 1 is configured for allowing the performance by the athlete of the "Hip Thrust" exercise.

Figure 1:
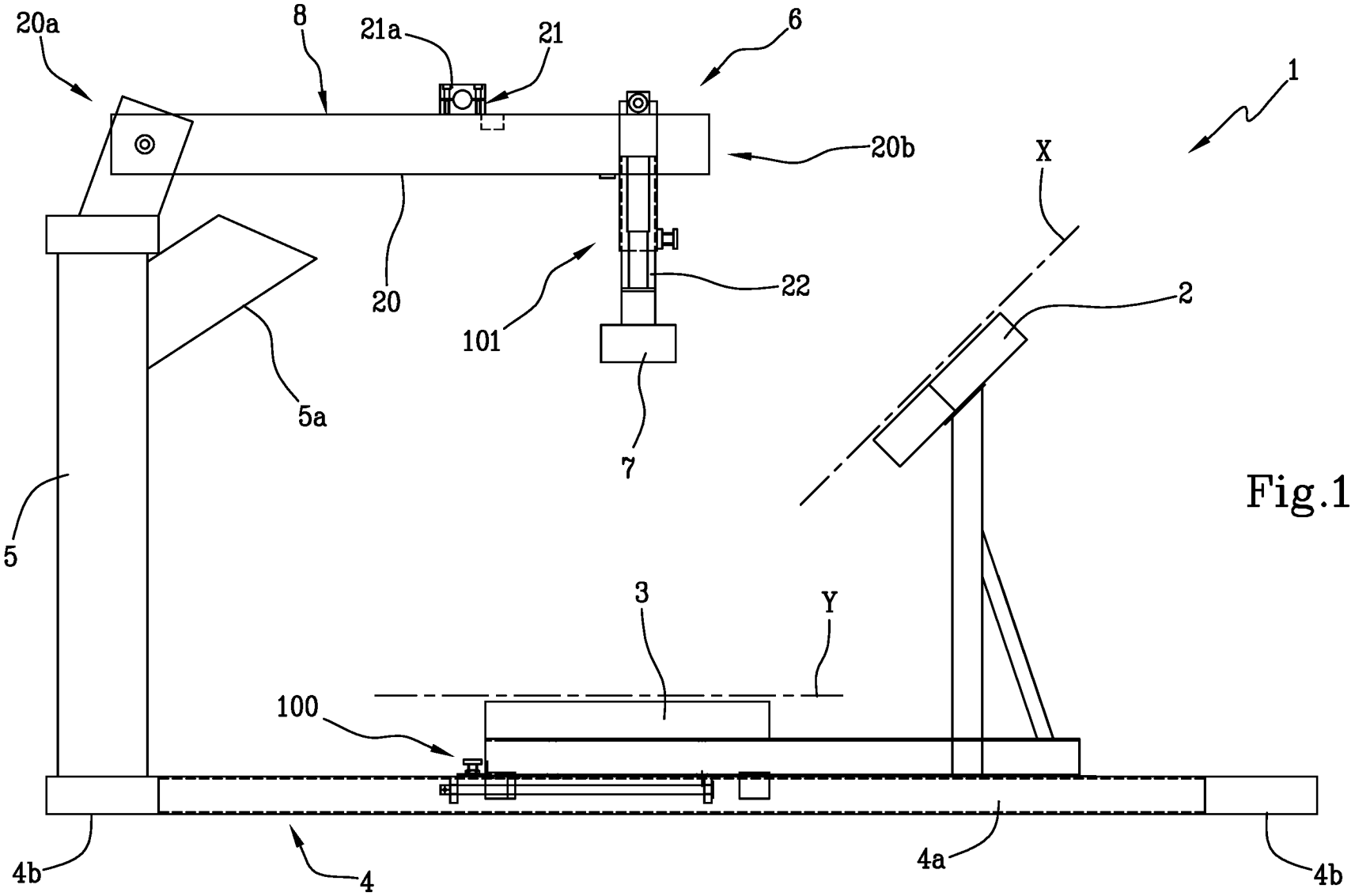
FIG. 1 is a side view of an assisted physical activity exercise machine.

More specifically, the machine illustrated in FIG. 1 comprises supporting means for a user, a base 4 equipped with the upright 5 and a training tool 6.

In accordance with the preferred embodiment of the invention, the supporting means for a user comprise a backrest 2 configured to give an adequate support to the user during the performance of the exercise. Preferably, the supporting means comprise a seat 3 in addition or alternatively to the backrest 2.

Preferably, the backrest has a padded portion designed to make the performance of the Hip Thrusts by the user more comfortable.

Still more preferably, the padded portion comprises a padding made of spongy material, such as, for example, foam rubber, and a covering of wear resistant material, such as, for example, leather, faux leather or similar materials.

In accordance with the embodiment shown in FIG. 1, the backrest lies mainly of a first plane of extension 'X'.

Advantageously, adjustment means, not illustrated in the drawings, allow the back to be reclined in order to ensure for the user a correct posture in accordance with the biomechanical principles which determine the adequate performance of the exercise.

In the embodiment shown in FIG. 1, the backrest is connected to a base 4, the base 4 is configured to give stability to the backrest during performance of the exercise.

The base is configured for supporting the machine 1 and is usually positioned on a supporting surface (not illustrated in the drawings) in a normal configuration.

Preferably, the base 4 is made in such a way as to support the machine 1 and impart stability and rigidity to the structure.

Still more preferably, the base 4 is made of a metallic material, such as, for example, iron or steel.

According to the preferred embodiment of the invention, the base 4 has an elongate element 4*a* which extends along a main direction of extension. The base 4 also has two cross-members 4*b* designed for imparting stability to the structure. The crosspieces 4*b* are substantially perpendicular to the main direction of extension of the elongate element 4*a* of the base 4.

More specifically, the elongate element 4*a* is configured for housing the supporting means for the user.

According to alternative embodiments not shown in the drawings, the base 4 may adopt arrangements and directions of extension different from those previously indicated, without altering the inventive concept of the invention.

More specifically, the base 4 is configured for housing the seat 3.

On the base 4 is slidably mounted a slide 100 configured for moving the seat 3 and/or of the backrest 2.

Advantageously, the slide 100 allows the adjustment of the positioning of the supporting means in a plurality of different positions in such a way as to make the performance of the exercise by the user more comfortable.

Preferably, the slide 100 makes it possible to move the seat towards or away from the backrest in such a way as to allow the user to maintain a correct posture from the biomechanical point of view during performance of the exercise.

In accordance with the embodiment shown in FIG. 1, the slide allows the sliding of the seat along the main direction of extension of the elongate element 4*a*.

The seat also lies mainly in a second plane 'Y' substantially parallel to the supporting surface on which the base 4 lies.

According to alternative embodiments not shown in the drawings, the adjustment means make it possible to modify the inclination of the seat 3 relative to the base 4 and also relative to the backrest 2.

In the accompanying drawings the base 4 comprises an upright 5 located in a distal position relative to the backrest and extending in a direction substantially perpendicular to the supporting surface of the machine 1.

According to alternative embodiments not shown in the drawings, the upright 5 may be arranged in positions proximal to that of the backrest and adopt directions of extension different from those previously indicated, without altering the inventive concept of the invention.

The upright is configured to support a training tool 6 designed for performing Hip Thrust exercises.

Preferably, the upright 5 is made of a high-strength material in such a way as to perform the function of supporting the training tool 6, absorbing any vibrations induced by the training tool 6.

Still more preferably, the upright 5 is made of a metallic material such as, for example, steel.

In the accompanying drawings the upright 5 is made in one piece with the base 4 and has a substantially tubular shape with a quadrangular base at the top of which is hinged the training tool 6.

Preferably, the upright 5 also comprises a supporting element 5*a*.

In accordance with the embodiment shown in FIG. 1, the supporting element 5*a* is made in one piece with the upright.

The supporting element 5*a* is configured to provide a support for the training tool 6 and limit its movement to predetermined positions.

More specifically, the training tool 6 is configured to rest on the supporting element 5*a* in a non-operating configuration of the machine 1. More precisely, the term "non-operating configuration" means the configuration in which the user is not performing the above-mentioned exercise. When the machine 1 is non-operating configuration, the presence of the seat 3 allows the user to be at least partially supported.

Advantageously, the training tool 6 may be rested on the supporting element 5*a* by a user upon completion of the exercise.

The training tool 6 comprises an engagement portion 7 and guide means 8 designed to guide the engagement portion 7 at least according to a lifting movement.

More specifically, the guide means 8 comprise a crosspiece 20, hinged at a first end 20*a* to the upright 5.

In accordance with a preferred embodiment, the crosspiece is hinged to the upper end, or top, of the upright and is configured to rotate in a substantially vertical plane.

The crosspiece 20 comprises at least one housing 21 designed to house at least one weight configured to increase the intensity of the physical exercise. The guide means 8 guide the engagement portion 7 in the lifting movement in contrast with the weight exerted by the weights.

Preferably, the housing 21 is configured to house at least one supporting element, for example a bar 'A', on which to mount weights in such a way as to adjust the load to the type of training which the user must carry out.

In accordance with an embodiment, the bar 'A' is positioned in the housing 21 of the crosspiece 20, in a direction substantially parallel to the supporting surface and perpendicular to that of the extension of the crosspiece, and is connected to it by a connecting element 21*a*.

The connecting element 21*a* is configured in such a way as to connect the supporting bar in the housing 21 by suitable fastening means, such as, for example, screws, bolts or the like.

The two ends of the bar 'A' determine the two supporting portions designed to house the weights for performing the exercise.

More specifically, the weights have a conventional disc shape with a through hole in the centre in such a way as to be slidably mounted on the bar 'A'.

In this configuration the crosspiece is interposed between the two ends of the bar and the weights are usually mounted in equal size on the two ends of the bar.

According to alternative embodiments not shown in the drawings, the supporting element may be replaced by a plurality of bars having directions of extension different to those previously indicated, without altering the inventive concept of the invention.

Preferably the clamping means, not shown in the drawings, such as, for example, butterfly clips or spring elements, keep the weights on the respective supporting portions.

The crosspiece is hinged in a relative second end to a supporting upright 22 designed to support the engagement portion 7 of the training tool.

In accordance with the embodiment presented in the accompanying drawings, the second end has a forklike shape.

Advantageously, the supporting upright 22 is housed between the prongs of the second end and is rotatably connected to them.

More specifically, the supporting upright 101 22 comprises a slidable slider designed to allow the sliding of the engagement portion 7 with respect to the supporting upright.

The slidable slide 101 of the supporting upright 22 is configured for adjusting the height of the engagement portion 7 relative to the base 4 in such a way as to make the performance of the exercise by the user more comfortable.

Figure 2:
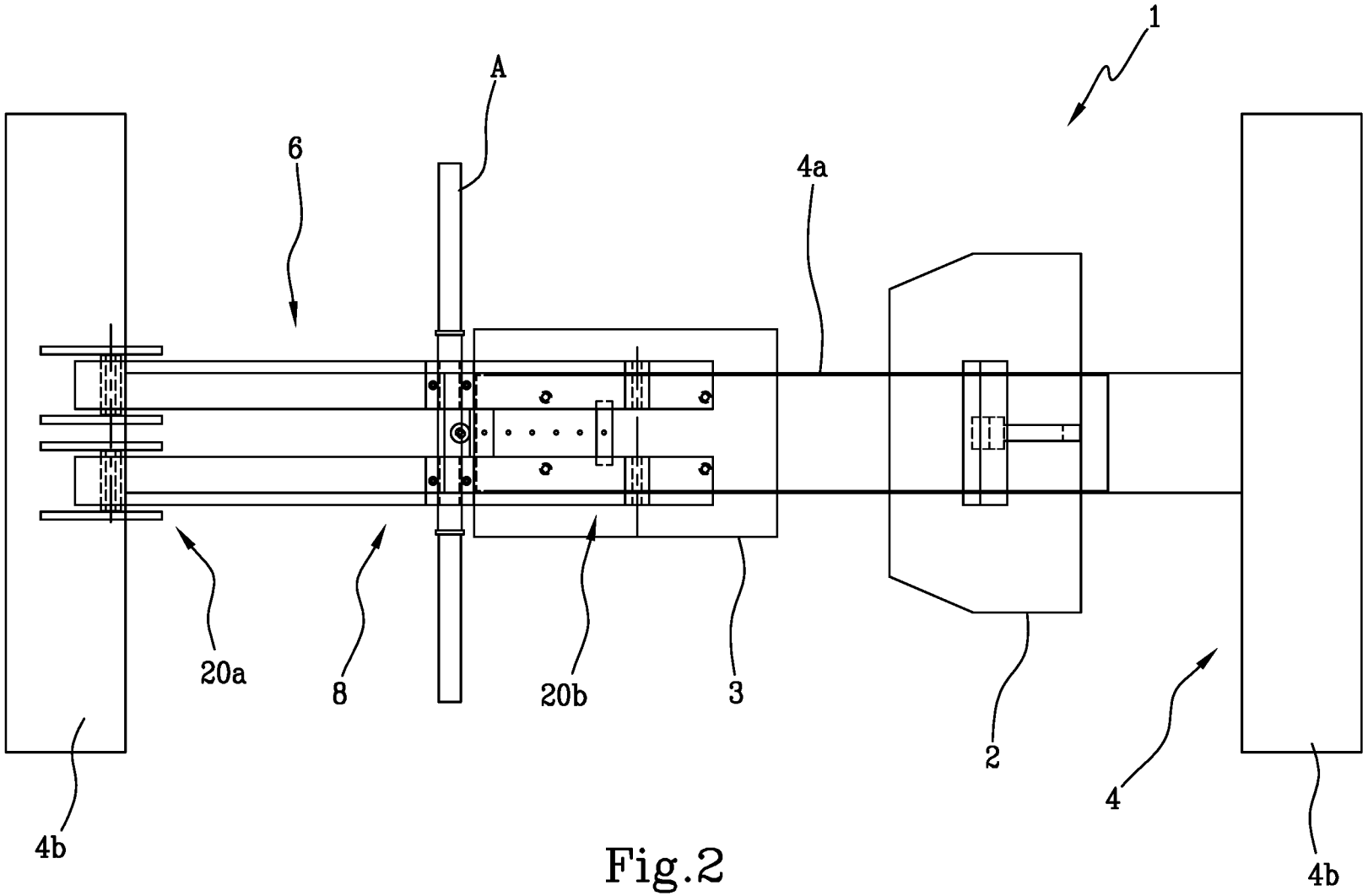
FIG. 2 is a top view of a portion of the assisted physical activity exercise machine of FIG. 1.

In accordance with the embodiment shown in FIGS. 1 and 2 the engagement portion 7 comprises a portion designed to rest on the user.

More specifically, the portion has a padding configured to abut on the pelvis of the user in an operating configuration.

In use, the user is positioned with his/her back on the backrest 2 and the soles of the feet resting on a supporting surface, generally the floor. The engagement portion 7 is raised relative to the ground and is configured for making contact on the pelvis of the user.

The user carries out one or more lifts of the pelvis, the so-called hip thrusts, in a substantially vertical direction in order to repeatedly lift the engagement portion and the relative training tool.

This movement may be repeated for a number of times, the so-called repetitions, depending on the type of training which must be performed.

At the end of performance of the exercise, the user can wait on the seat for the subsequent repetition whilst the training tool 6 is positioned resting on the supporting element 5*a*.

It should therefore be noted that the invention achieves the set aim by providing the user with an assisted physical activity exercise machine which allows performance of Hip Thrusts in complete safety and in compliance with the biomechanical principles which determine the correctness of the movements during the exercises of athletes.

This aim is achieved thanks to the use of a slide which is slidably mounted on the base according to an adjustment movement and supporting the seat and/or the backrest.

Advantageously, the sliding guide allows the user to adjust the assisted physical activity exercise machine in such a way as to maintain a correct positioning during performance of the exercise from both a kinesiological and biomechanical point of view.

Advantageously, the paddings present on the support means and on the engagement portion make the performance of the Hip Thrust more comfortable.

Advantageously, the base gives stability to the structure and guarantees to the user a performance of the physical activity in total safety.

Advantageously, the housing for the weights allows an equal distribution of the loads and prevents the user from adopting improper positions during performance of the exercise which often cause injuries and muscular lesions.

Advantageously, the training tool, together with the upright and the supporting element, makes it possible to perform the exercise independently, keeping the user safe during the physical activity.

The invention claimed is:

1. A machine for performing Hip Thrusts, comprising:

a base;

supporting means for a user, comprising a seat and a backrest;

a training tool mounted on the base and comprising an engagement portion, configured to be actuated by the user, and guiding means associated with the engagement portion for guiding the engagement portion at least according to a lifting movement; said supporting means being mounted on the base and comprising a slide slidably mounted on the base;

an upright designed to support the training tool, the upright being located in a distal position relative to the backrest, said upright comprising a supporting element designed to support the training tool in a non-operating condition, wherein the guiding means comprises a crosspiece having a first end hinged to the upright and a second end connected to the engagement portion, the crosspiece being configured for resting on the supporting element at least in the non-operating condition, wherein the guiding means comprises a supporting upright hinged to the second end of the crosspiece, the supporting upright being designed to support the engagement portion, the supporting upright is housed between prongs of the second end and is rotatably connected to said prongs, wherein the supporting upright comprises a slidable slider designed to allow the sliding of the engagement portion relative to the supporting upright.

2. The machine according to claim 1, wherein the slide supports the seat and the backrest and is configured for allowing a relative motion between the seat and the backrest.

3. The machine according to claim 1, wherein the backrest lies mainly in a first plane and the seat lies mainly in a second plane.

4. The machine according to claim 1, wherein at least the second end of the crosspiece has a forklike shape.

5. The machine according to claim 1, wherein the crosspiece comprises a housing configured for housing a gravity body in an operating condition.

* * * * *